US005363657A

United States Patent [19]

Naumovitz

[11] Patent Number: 5,363,657

[45] Date of Patent: Nov. 15, 1994

[54] SINGLE COLUMN PROCESS AND APPARATUS FOR PRODUCING OXYGEN AT ABOVE-ATMOSPHERIC PRESSURE

[75] Inventor: Joseph P. Naumovitz, Lebanon, N.J.

[73] Assignee: The BOC Group, Inc., New Providence, N.J.

[21] Appl. No.: 60,144

[22] Filed: May 13, 1993

[51] Int. Cl.[5] ..... F25J 3/02

[52] U.S. Cl. ..... 62/39; 62/24

[58] Field of Search ..... 62/39, 24

[56] References Cited

U.S. PATENT DOCUMENTS

| | | | |
|---|---|---|---|
| 3,203,193 | 2/1963 | Ruhemann et al. | 62/13 |
| 3,500,651 | 3/1970 | Becker | 62/39 X |
| 3,756,035 | 9/1973 | Yearout | 62/39 X |
| 4,072,023 | 2/1978 | Springman | 62/13 |
| 4,133,662 | 1/1979 | Wagner | 62/39 X |
| 4,357,153 | 11/1982 | Erickson | 62/39 X |
| 4,496,383 | 1/1985 | Hubbard et al. | 62/31 |
| 4,617,037 | 10/1986 | Okada et al. | 62/11 |
| 4,696,689 | 9/1987 | Mori et al. | 62/32 |
| 4,848,996 | 7/1989 | Thorogood et al. | 62/39 |
| 4,867,773 | 9/1989 | Thorogood et al. | 62/39 |
| 4,869,742 | 9/1989 | Thorogood et al. | 62/32 |
| 4,966,002 | 10/1990 | Parker et al. | 62/39 X |
| 5,123,946 | 6/1992 | Ha | 62/11 |

*Primary Examiner*—Henry A. Bennett
*Assistant Examiner*—Christopher Kilner
*Attorney, Agent, or Firm*—David M. Rosenblum; Larry R. Cassett

[57] ABSTRACT

A process and apparatus for separating air in which a refrigerant stream produced at the top of a single column is expanded with the performance of work. Such expansion can be carried out in an expansion machine coupled to a recycle compressor by an energy dissipative brake. An oxygen stream is removed from a bottom region of the column and a compressor compresses an oxygen stream to column pressure which is at an above atmospheric delivery pressure. After compression, the oxygen stream is divided into two partial streams. One of the two partial streams is fed back into a bottom region of the column as a vapor to provide boil up while the other of the two partial streams is taken as a product which having been derrived from the compressed stream is therefore at the above-atmospheric delivery pressure. The refrigerant stream is heat exchanged countercurrently with incoming air to be separated in order to add refrigeration.

10 Claims, 1 Drawing Sheet

SINGLE COLUMN PROCESS AND APPARATUS FOR PRODUCING OXYGEN AT ABOVE-ATMOSPHERIC PRESSURE

BACKGROUND OF THE INVENTION

The present invention relates to a process and apparatus for rectifying air in a single column to produce oxygen. More particularly, the present invention relates to such a process and apparatus in which the single column operates at an above-atmospheric pressure to produce the oxygen at an above-atmospheric delivery pressure.

The prior art has provided a variety of processes and apparatus to rectify air within various single column arrangements to produce an oxygen product. In a typical single column oxygen producing plant, air is compressed, purified, cooled to a temperature suitable for its rectification and then introduced into a heat exchanger in the bottom of the column to provide boil-up against the partial liquefaction of the air. The air is thereafter introduced into the column, at an intermediate location thereof. The air is distilled in the column to produce a liquid oxygen column bottom and a nitrogen vapor tower overhead. The column typically operates slightly above atmospheric pressure. As a result, the liquid oxygen must again be pumped to increase its pressure to a delivery pressure. As can be appreciated, such pumping represents an energy outlay which adds to the operating overhead involved in producing the oxygen product.

As will be discussed, the present invention provides a process and apparatus in which air is distilled in a column to produce an oxygen product at an above-atmospheric delivery pressure without the necessity of there being any additional energy outlay involved in increasing the pressure of the oxygen product to the delivery pressure.

SUMMARY OF THE INVENTION

The present invention provides a process for separating oxygen from air to form an oxygen product at an above-atmospheric delivery pressure. In accordance with the process, air is compressed to the above-atmospheric delivery pressure, the heat of compression is removed and the air purified. Thereafter, the air is cooled to a temperature suitable for its rectification. The air is rectified in a rectification column operating at the above-atmospheric delivery pressure and such that a nitrogen vapor tower overhead and a liquid oxygen column bottom are produced within top and bottom regions of the column. Additionally, a nitrogen-rich vapor is produced below the nitrogen vapor tower overhead. A refrigerant stream is removed from the column. The refrigerant stream is composed of either the nitrogen-rich vapor or the nitrogen vapor tower overhead. Additionally, a reflux stream composed of the nitrogen vapor tower overhead and an oxygen stream composed of the liquid oxygen column bottom are also removed. The oxygen stream is vaporized against at least partially condensing the reflux stream. At least part of the reflux stream is returned back to the column as reflux and the oxygen stream is compressed to essentially the above-atmospheric delivery pressure of the column. Thereafter, the oxygen stream is divided into two partial streams. One of the two partial streams is cooled to essentially, a dewpoint temperature and is then introduced into the bottom region of the column as a vapor to provide boil-up in the bottom region of the column. The refrigerant stream is expanded with the performance of work. Thereafter, it is warmed against the cooling of the air and the one of the two partial streams to add refrigeration to the process. The oxygen product is recovered from the other of the two partial streams.

In another aspect, the present invention provides an apparatus for separating oxygen from air to produce an oxygen product at an above-atmospheric delivery pressure. The apparatus comprises a means for compressing the air to essentially the above-atmospheric delivery pressure, a means for removing heat of compression from the air and a means for purifying the air. A column is provided for rectifying the air after the air has been cooled to a temperature suitable for its rectification. The air is rectified in the column to produce a nitrogen vapor tower overhead and a liquid oxygen column bottom within top and bottom regions of the column and a nitrogen-rich fraction located below the nitrogen vapor tower overhead. A condenser means is provided for at least partially condensing a reflux stream composed of the nitrogen vapor tower overhead against vaporizing an oxygen stream composed of the liquid oxygen column bottom. A reflux return means is provided for returning at least part of the reflux stream back to the column as reflux. A recycle compression means is connected to the condenser means for compressing the oxygen stream to essentially at least the above-atmospheric delivery pressure. A dividing means is connected to the recycle compression means for dividing the oxygen stream into two partial streams. An expansion means is provided for expanding a refrigerant stream, composed of either the nitrogen vapor tower overhead or the nitrogen vapor, with the performance of work. A heat exchange means is provided for cooling the air to the temperature suitable for its rectification and for cooling one of the two partial streams to essentially, a dewpoint temperature against fully warming the refrigerant stream and the other of the two partial streams. The heat exchange means is connected to the column such that the air is introduced into an intermediate point of the column and the other of the two partial streams is introduced into the bottom region of the column to provide boil-up for the bottom region.

As can be appreciated, in any method and apparatus in accordance with the present invention, part of the work of expansion can be used to drive a recycle compressor used in compressing the oxygen to the delivery pressure. Since a partial stream from the recycle compressor is recovered as product, less energy need be expended than in prior art teachings in raising the pressure of the product stream to the above-atmospheric delivery pressure. It is to be noted that the applicable streams are compressed to "essentially" the intended delivery pressure due to inevitable losses known well in the art.

BRIEF DESCRIPTION OF THE DRAWINGS

While the specification concludes with claims particularly pointing out and distinctly claiming the subject matter that Applicant regards as his invention, it is believed that the invention will be better understood from the sole accompanying figure which is a schematic of an apparatus for practicing a method in accordance with the present invention. It is understood that reference numerals designating process streams also designate piping hardware used in connecting major components of the apparatus.

DETAILED DESCRIPTION

Figure 1:
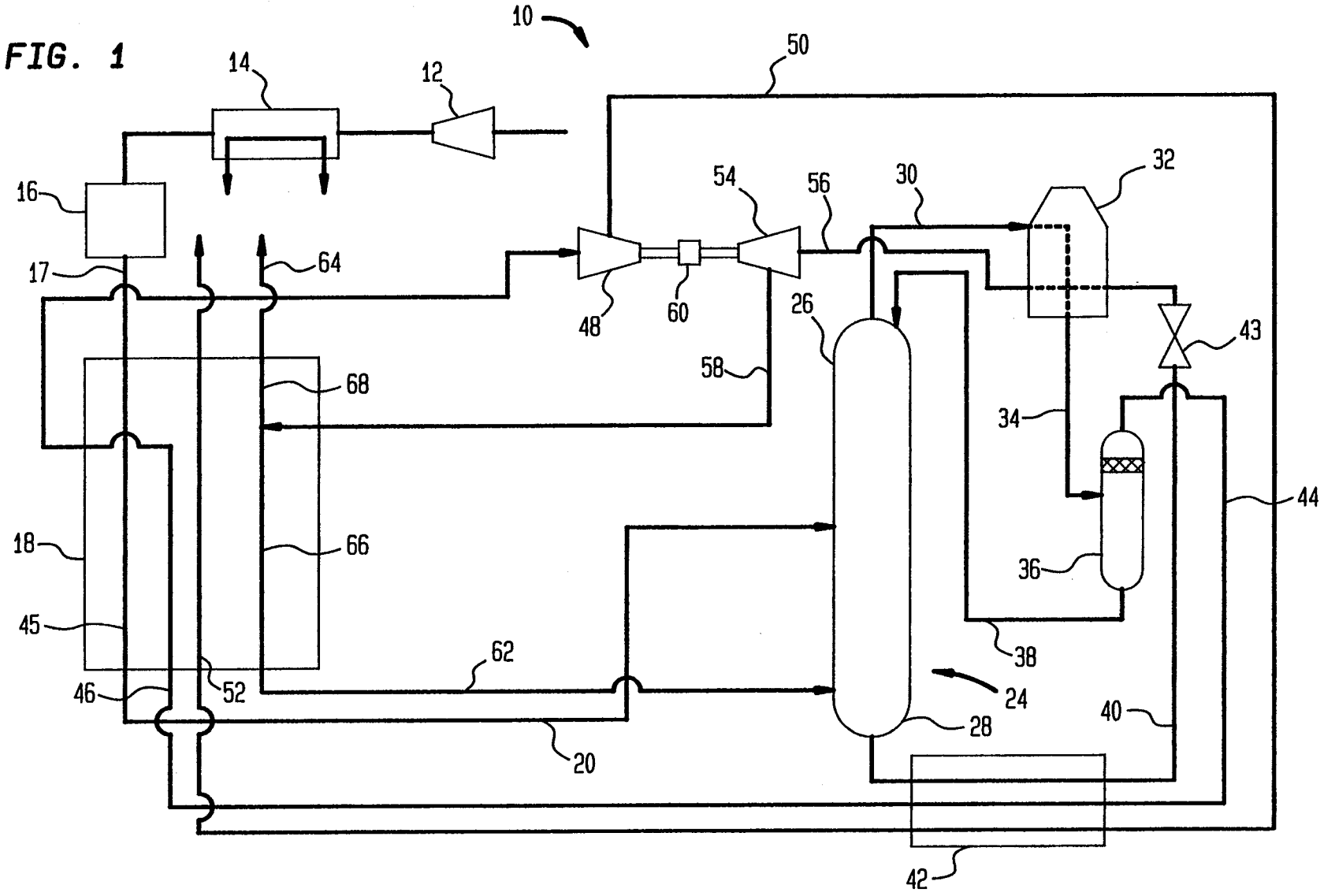

With reference to the figure, an apparatus 10 in accordance with the present invention is illustrated. In a conventional manner, air is compressed in an air compressor 12 to essentially the above-atmospheric delivery pressure. The heat of compression is then removed by an aftercooler 14 and the compressed air is then purified by a prepurification unit 16 (preferably a PSA unit having beds of activated alumina and molecular sieve material operating out of phase) to remove carbon dioxide, moisture, and possibly hydrocarbons. The air, as an air stream 17, is then cooled in a main heat exchanger 18 to a temperature suitable for rectification which would lie at or near the dewpoint of the air. Main heat exchanger 18, is preferably of plate-fin design.

After the air is suitably cooled, it is introduced as a stream 20 into a rectification column 24 having approximately 30 theoretical stages formed by trays of conventional design and efficiency, or the equivalent in structured or random packing or any other gas-liquid mass transfer element that could be used to bring into intimate contact ascending vapor and descending liquid phases within column 24. Column 24 has top and bottom regions 26 and 28 in which nitrogen vapor and liquid oxygen fractions are produced, respectively. At the very top of column 24 a nitrogen vapor tower overhead is formed and below the nitrogen vapor tower overhead a nitrogen rich vapor is formed having a lower nitrogen purity than at the top of the column.

The nitrogen vapor tower overhead is removed from top region 26 of column 24 as a nitrogen reflux stream 30. Nitrogen reflux stream 30 is partially condensed within head condenser unit 32. Partially condensed reflux stream 34 is then introduced into phase separator 36 to produce liquid and vapor phases. The liquid phase is returned to top region 26 of column 24 as reflux by way of reflux stream 38. The condensation within head condenser 32 is effected by withdrawing an oxygen stream 40 composed of liquid oxygen. Oxygen stream 40 is subcooled within a subcooler 42 and is then lowered in temperature by irreversible expansion within a pressure reduction valve 43 prior to being introduced into head condenser 32. Subcooler 42 is of conventional plate-fin design.

It is understood that an embodiment of the present invention is possible in which nitrogen reflux stream 30 is fully condensed and all or some of the condensate is returned to top region 26 of column 24. That part of the condensate not returned could be routed through subcooler 42 counter-current to the direction of flow of oxygen stream 40 and then through main heat exchanger 18 in a direction counter-current to the air feed.

Refrigeration is supplied in order to balance heat leakage into the cold box and the warm end heat losses. To this end, the vapor phase produced within phase separator 36 is withdrawn as a nitrogen stream 44 which is sent through subcooler 42 in order to help subcool oxygen stream 40. Stream 44 is sent through the main heat exchanger which is provided with a first passage way 45 through which air passes from purification unit 16 into column 24. The main heat exchanger is also provided with a second passageway 46 in which the nitrogen stream partially warms by passing in a direction countercurrently to the flow of air. In this regard, the term "fully warm" means that a stream has been warmed to the ambient, that is, the warm end of the main heat exchanger, "fully cooled" means the stream has been cooled to a temperature of the cold end of the main heat exchanger, namely at about the dew point of air. "Partially cooled" or "partially warmed" means that the stream either passes in a direction of the air flow or counter-currently to the direction of the air flow, respectively, and is withdrawn from the main heat exchanger at a temperature intermediate that of the warm and cold ends of the main heat exchanger. After having been partially warmed, nitrogen stream 44 is introduced into a turboexpander 48 or other machine capable of expanding stream 44 with the performance of work to produce a refrigerant stream 50. Refrigerant stream 50 passes through subcooler 42 where it aids in subcooling oxygen stream 40 and then passes through a third passageway 52 of the main heat exchanger in which it fully warms and passes out of apparatus 10 as a waste stream or possibly as a low pressure nitrogen co-product. Refrigerant stream 50 passes through third passage 52 of the main heat exchanger, in a counter-current direction to the entering air flowing through first passageway 45. The enthalpy of the incoming air is thereby lowered to add refrigeration to the system.

It is to be noted in a possible embodiment of the present invention, the refrigerant stream could be formed from nitrogen-rich vapor. In such case, all or a portion of the nitrogen tower vapor overhead would be used as reflux.

Oxygen stream 40 after having been fully vaporized in condenser 32 is passed into a recycle compressor 54 as an oxygen vapor stream 56. After passage through recycle compressor 54, a compressed oxygen stream 58 is formed. Compressed oxygen stream 58 has a pressure of essentially the above-atmospheric delivery pressure. Compressor 54 is driven by turboexpander 48 through a heat dissipative brake 60 which rejects excess work of expansion from the cold box as heat. Oxygen stream 40 is therefore being compressed at cold, column temperature. This is preferred over compressing oxygen after having been fully or partially warmed because of reduced work requirements involved in compressing cold oxygen.

Compressed oxygen stream 58 is then divided into two partial streams 62 and 64 either before or within main heat exchanger 18. Partial stream 62 is cooled to a near dewpoint temperature in a fourth passage 66 of the main heat exchanger. Afterwards, it is introduced as essentially a vapor into bottom region 28 of column 24 to provide boil-up in such bottom region. It is to be noted that the term "essentially" here connotes that there can be some liquid content for instance in the neighborhood of 2%. Therefore, more accurately, partial stream 62 is cooled to essentially dewpoint temperatures. The other of the two partial streams 64 is fully warmed within main heat exchanger 18 by flow through a fifth passage 68 thereof. After being fully warmed, the stream is taken off as the oxygen product. Partial stream 64 could be removed as a product without passing it through main heat exchanger 18. In such case, recovery would be reduced. Since partial stream 64 has been formed of a stream compressed to essentially the above-atmospheric delivery pressure, it thus, essentially has such pressure at delivery.

EXAMPLE

The following is a computer simulation of a typical operation of apparatus 10.

Table of Flows, Temperatures, Pressures and Composition

| Stream | Flow $Nm^3/hr$ | Temp. Degree K | Pressure Atm | % $N_2$ | % Ar | % $O_2$ |
|---|---|---|---|---|---|---|
| 17 | 1000 | 299.8 | 7.01 | | | |
| 20 (5.6K above dew point) | 1000 | 108.2 | 6.91 | | | |
| 40 before subcooling in subcooler 40 | 695.7 | 113.2 | 6.98 | 2.41 | 2.59 | 95.00 |
| 40 after subcooling in subcooler 40 (subcooled liquid) | | 104.0 | 6.95 | | | |
| 40 after expansion in valve 43 (5.14% vapor) | | 98.2 | 2.28 | | | |
| 44 (saturated vapor) | 811.9 | 99.3 | 6.85 | 95.65 | 0.55 | 3.80 |
| 50 after having been fully warmed within main heat exchanger 18 | 811.9 | 297.09 | 1.16 | 95.65 | 0.55 | 3.80 |
| 50 before being partially warmed in main heat exchanger 18 | 811.9 | 106.9 | 6.82 | 95.65 | 0.55 | 3.80 |
| 50 prior to being fully warmed within main heat exchanger 18 | 811.9 | 106.9 | 1.24 | 95.65 | 0.55 | 3.80 |
| 50 before turboexpander 48 | 811.9 | 152.7 | 6.76 | | | |
| 50 after expansion in turboexpander 48 | | 100.7 | 1.26 | | | |
| 56 (100% vapor) | | 98.2 | 2.21 | | | |
| 58 | 695.5 | 153.3 | 7.05 | 2.41 | 2.59 | 95.00 |
| 62 (2% liquid) | 507.6 | 113.6 | 6.98 | | | |
| 68 | 188.1 | | | | | |
| 68 after having been fully warmed within main heat exchanger 18 | 188.1 | 297.0 | 7.03 | 2.41 | 2.59 | 95.00 |

It is understood that while the present invention has been discussed with reference to a preferred embodiment, as will occur to those skilled in the art, numerous additions, changes and omissions may be made without departing from the spirit and scope of the present invention.

I claim:

1. A process of separating oxygen from air to form an oxygen product, said process comprising:

compressing and purifying the air;

cooling the air to a temperature suitable for its rectification;

rectifying the air in a rectification column operating at a superatmospheric pressure and such that a nitrogen vapor tower overhead and a liquid oxygen column bottom are produced within top and bottom regions of the column and a nitrogen rich vapor is produced below the nitrogen vapor tower overhead;

removing from the column a refrigerant stream composed of either the nitrogen rich vapor or the nitrogen vapor tower overhead, a reflux stream composed the nitrogen vapor tower overhead, and an oxygen stream composed of the liquid oxygen column bottom;

vaporizing the oxygen stream against at least partially condensing the reflux stream, returning at least part of the reflux stream back to the column as reflux, compressing all of the oxygen stream to at least the superatmospheric pressure of the column and thereafter, dividing the oxygen stream into two partial streams;

cooling one of the two partial streams to essentially a dewpoint temperature and then introducing it into the bottom region of the column as a vapor to provide boilup in said bottom region of the column;

partially warming the refrigerant stream against the cooling of the air and the one of the two partial streams, expanding the refrigerant stream with performance of work, and then, fully warming the refrigerant stream against the cooling of the air and the one of the two partial streams to add refrigeration to the process;

applying the performance of the work of the expansion to the compression of the oxygen stream so that all required compression work for compressing the oxygen stream is supplied from at least part of the work of the expansion recovering the oxygen product from the other of the two partial streams.

2. The process of claim 1, wherein the oxygen stream is compressed at the column temperature.

3. The process of claim 1, wherein the nitrogen stream is warmed against the cooling of the air and the one of the two partial streams.

4. The process of claim 1, the refrigerant stream is expanded with the performance of work by introducing the refrigerant stream into an expansion machine coupled to a recycle compressor, used in compressing the oxygen stream, by a heat dissipative brake.

5. The process of claim 1, wherein:

the oxygen stream is compressed at the column temperature;

the oxygen stream is compressed by introducing it into a recycle compressor;

the refrigerant stream is partially warmed against the cooling of the air and the one of the two partial streams; and the refrigerant stream is expanded with the performance of work by introducing the refrigerant stream into an expansion machine coupled to the compressor by a heat dissipative brake.

6. An apparatus for separating oxygen from air to produce an oxygen product, said apparatus comprising:

means for compressing the air;

means for purifying the air;

a column for rectifying the air after having been cooled to a temperature suitable for its rectification to produce a nitrogen vapor tower overhead and a liquid oxygen column bottom within top and bottom regions of the column and a nitrogen rich fraction located below the nitrogen vapor tower overhead;

condenser means for at least partial condensing a reflux stream composed of the nitrogen vapor tower overhead against vaporizing an oxygen stream composed of the liquid oxygen column bottom;

reflux return means for returning at least part of the reflux stream back to the column as reflux;

recycle compression means connected to the condenser means for compressing all of the oxygen stream to at least the superatmospheric pressure;

dividing means connected to the compression means for dividing the oxygen stream into two partial stream;

expansion means for expanding a refrigerant stream, composed of either the nitrogen vapor tower overhead or the nitrogen-rich vapor, with performance of work;

the expansion means coupled to the recycle compression means so that all required compression work for compressing the oxygen stream is supplied from at least part of the work of the expansion; and heat exchange means for cooling the air to the temperature suitable for its rectification and for cooling one of the two partial streams to essentially, a dewpoint temperature against partially and then fully warming the refrigerant stream and fully the other of the two partial streams, the heat exchange means connected to the column such that the air is introduced into an intermediate point of the column and the other of the two partial streams is introduced into the bottom region of the column to provide boilup for said bottom region and the heat exchange means connected to the expansion means such that the refrigerant stream is introduced to the expansion means after having been partially warmed and is fully warmed after having been expanded.

7. The apparatus of claim 6, wherein:

the expansion means comprises a turboexpander;

the recycle compression means comprises a recycle compressor; and the turboexpander is connected to the recycle compressor by an energy dissipative brake.

8. The apparatus of claim 7, wherein:

the condenser means partially condenses the reflux stream;

the reflux return means comprises a phase separation tank connected to the condenser means so as to form liquid and vapor phases of the reflux stream and connected to the column so that a stream of the liquid phase is returned to the column as reflux; and the turboexpander is connected to the phase separation tank to expand the vapor phases and thereby form the refrigerant stream from the nitrogen vapor tower overhead.

9. The apparatus of claim 6, wherein:

the recycle compression means comprises a recycle compressor; and the recycle compressor is connected to the condenser means so that the oxygen stream is compressed at column temperature.

10. The apparatus of claim 8, wherein the recycle compressor is connected to the condenser means so that the oxygen stream is compressed at column temperature.

* * * * *